US005218169A

United States Patent [19]

Riceman

[11] Patent Number: 5,218,169

[45] Date of Patent: * Jun. 8, 1993

[54] CHILD CARE ELECTRICAL OUTLET SAFETY COVER

[75] Inventor: Robert G. Riceman, West Caldwell, N.J.

[73] Assignee: Randolph-Rand Corporation, New York, N.Y.

[ * ] Notice: The portion of the term of this patent subsequent to Sep. 3, 2008 has been disclaimed.

[21] Appl. No.: 657,812

[22] Filed: Feb. 20, 1991

Related U.S. Application Data

[63] Continuation-in-part of Ser. No. 502,282, Mar. 30, 1990, Pat. No. 5,045,640.

[51] Int. Cl.[5] ..... H01R 13/447

[52] U.S. Cl. ..... 174/67

[58] Field of Search ..... 174/67; 220/242; 439/136, 142, 147

[56] References Cited

U.S. PATENT DOCUMENTS

| | | | |
|---|---|---|---|
| 2,526,606 | 10/1950 | Gregg | 174/67 |
| 4,424,407 | 1/1984 | Barbic | 174/67 |
| 4,603,932 | 8/1986 | Heverly | 174/67 X |
| 4,652,696 | 3/1987 | Winnick | 174/67 |
| 4,688,747 | 8/1987 | Helmsdorfer et al. | 174/67 X |
| 4,851,612 | 7/1989 | Peckham | 174/67 |
| 4,899,019 | 2/1990 | Riceman | 174/67 |
| 5,045,640 | 9/1991 | Riceman | 174/67 |

*Primary Examiner*—Leo P. Picard
*Assistant Examiner*—David A. Tone
*Attorney, Agent, or Firm*—Wenderoth, Lind & Ponack

[57] ABSTRACT

A safety cover for an electric receptacle has a mounting plate fitting over an electrical receptacle, and a cover assembly with a cover edge extending around the periphery thereof, the mounting plate having an edge engagable surface thereon corresponding in shape to the cover edge. The cover assembly is mountable on the mounting plate between a closed and an open position. The cover assembly has a plurality of locking projections spaced around the periphery of the cover assembly at positions so that they are incapable of simultaneous operation by a hand below a predetermined size. When the cover assembly is closed, locking hooks on the locking projections engage in locking hook receiving apertures in the mounting plate structure and the cover edge is snugly abutted against the edge engagable surface. The cover assembly can be moved to the open position only by simultaneous deformation of the cover assembly at the positions of the locking hooks sufficient to move the locking hooks sufficiently far inwardly of the cover assembly to free the locking hooks from the locking hook receiving apertures.

10 Claims, 4 Drawing Sheets

FIG. 1
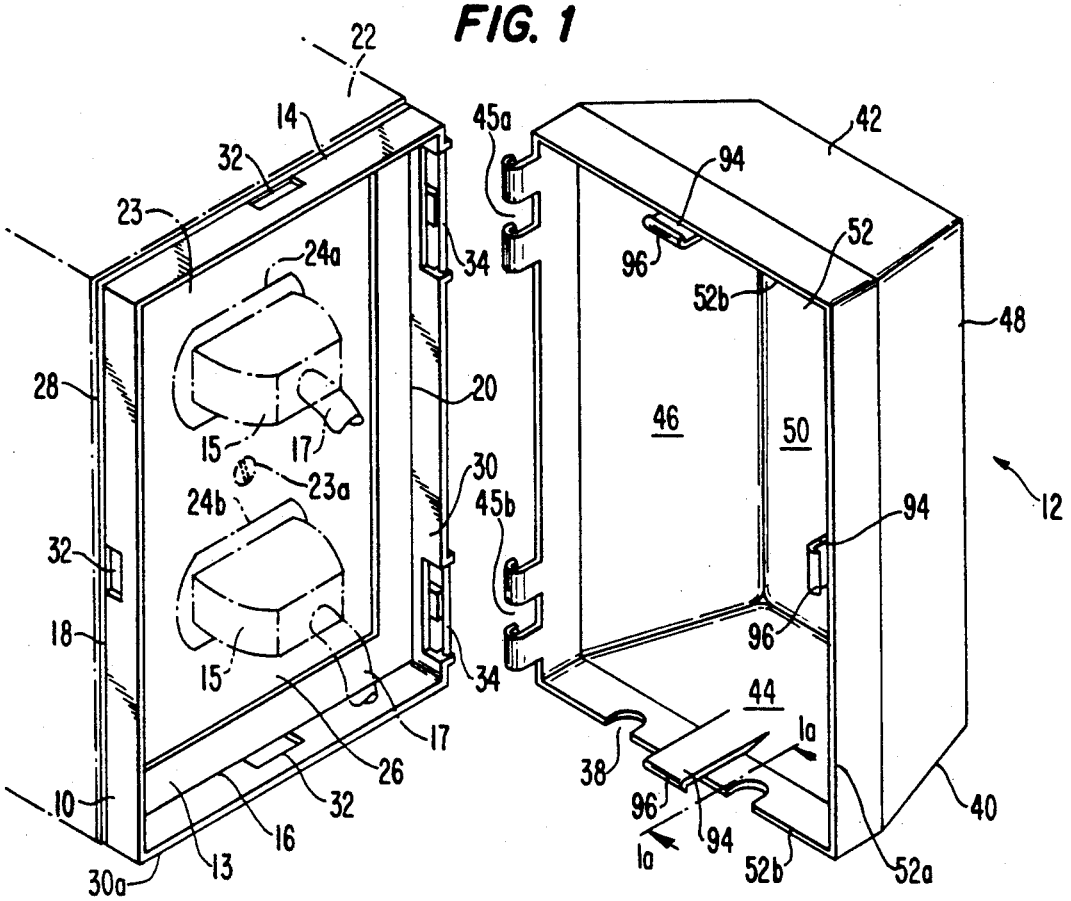
FIG. 1b
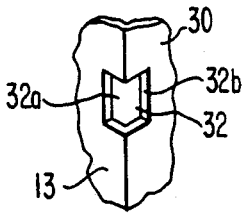
FIG. 1a
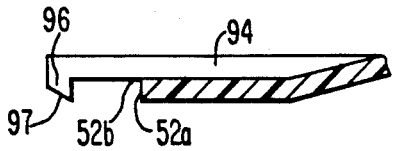
FIG. 1c
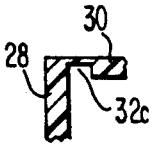
FIG. 2
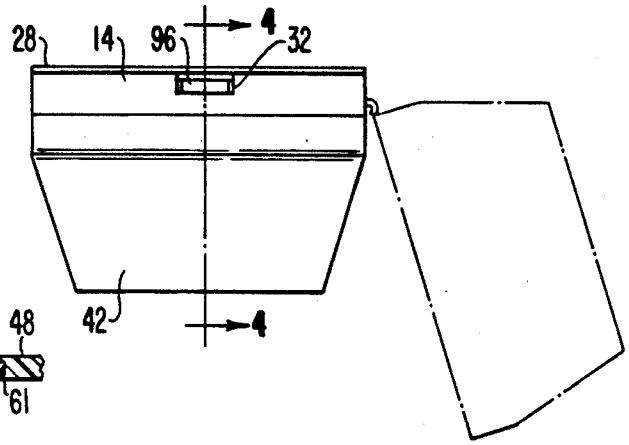
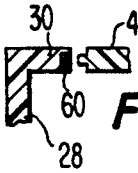
FIG. 2a
FIG. 2b
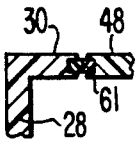

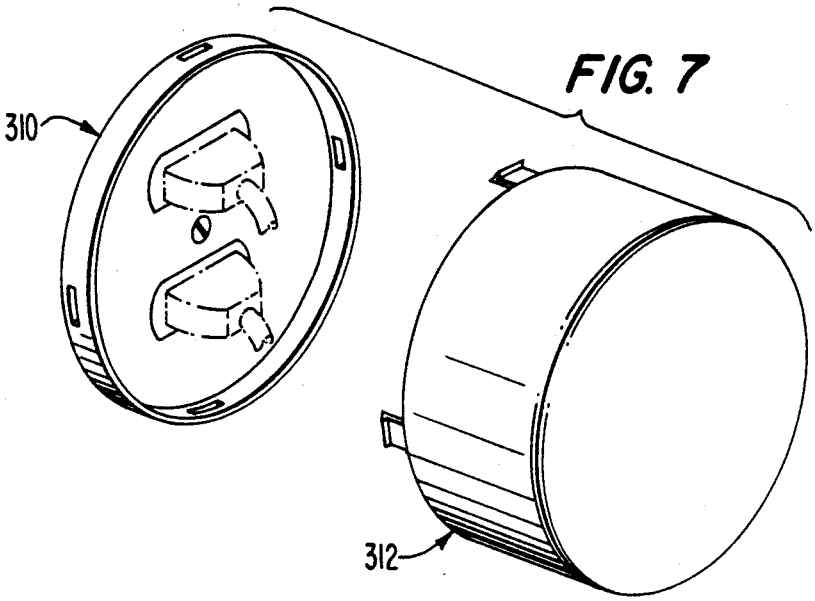
FIG. 7
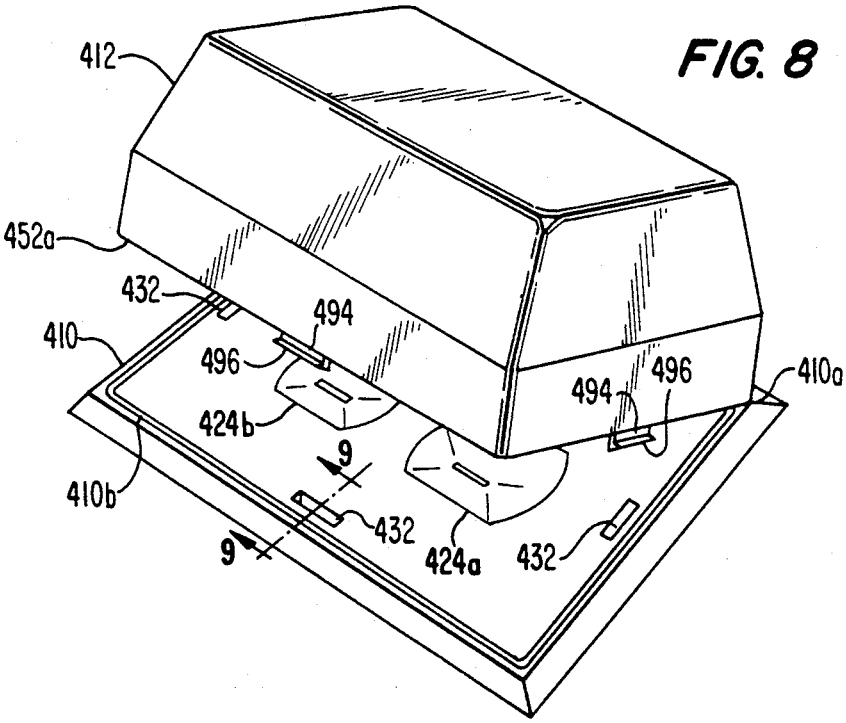
FIG. 8
FIG. 9
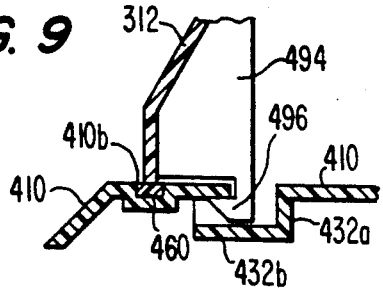

CHILD CARE ELECTRICAL OUTLET SAFETY COVER

This application is a continuation-in-part of U.S. patent application Ser. No. 07/502,282, filed Mar. 30, 1990, U.S. Pat. No. 5,045,640.

BACKGROUND OF THE INVENTION

This invention relates to a safety cover for an electrical receptacle, and more particularly, to a combination base-plate and housing member which can be connected and capable of being locked so as to prevent access by young children or the like. The invention is designed so that an electrical plug may be plugged into the electrical receptacle while the housing member is in the locked position.

Electrical wall receptacles present much danger to young children and others who make accidential contact with such current-carrying outlets. Compounding this danger is the fact that electrical cords often suffer wear at the area where the cord meets the electrical plug. This is particularly dangerous when the receptacle or plug is exposed to water, as with an outdoor receptacle.

Safety guards designed to prevent unauthorized access to electrical receptacles do currently exist. All, however, are limited in their effectiveness or marketability due to the following reasons.

The simplest form of safety cover currently available consists of a small plastic disk with prongs extending laterally from one of its flat surfaces. This design is effective only against the smallest of children since it can be easily removed by any child physically capable of grasping and pulling an object. This category includes children as young as one year of age. This weakness is further aggravated by the action of removing and replacing these plugs as they are held in place by friction. This friction abrades the plastic prongs as they are repeatedly inserted and removed from the metal contacts within the receptacle.

More sophisticated safety devices also exist such as U.S. Pat. No. 2,526,606 which discloses a protective hood that snaps onto a special base plate. The hood engages the base plate by means of a series of interlocking flanges, each locking flange on the cover having a corresponding receiving flange on the base plate. Removal of the hood is accomplished by flexing one of its two longitudinal edges inwardly to disengage the locking flanges on the hood from those on the base plate. The patent discloses that the hood is made of sufficiently strong material so that the pressure required to release it is more than the average small child can exert. In other words, the effectiveness of this device is limiting a child's access to the receptacle and is totally dependent upon a child's ability to exert enough physical pressure on a single point on the hood. While the average small child may not be able to flex the hood inwardly with his or her hand, it will be appreciated that a small child could, by kicking or striking the hood with a toy or other implement, exert sufficient force to dislodge it from the base plate. Accordingly, protective devices which rely merely upon a child's limited strength may prove ineffective in many situations.

Another approach to the problem of protecting children from hazards associated with electrical outlets has been to cut the power to the outlet entirely when the outlet is exposed. For example, U.S. Pat. No. 2,439,708 discloses an electrical outlet with a hinged cover box having arms attached thereto which cooperate with a switch that connects the electrical lead wires to the contacts of the outlet. In operation, when the cover box is in the closed position (preventing access to the outlet), the outlet is energized. When this covering box is in its open position (unlatched and swung away from the outlet), the power to the receptacle is shut off.

While it can be appreciated that this feature of turning the power off when the outlet is exposed may be somewhat more effective than other approaches which rely solely on limiting physical access to the outlet, it is also complex and rather costly to implement. Furthermore, repeated opening and closing of the cover box subjects various component parts to wear, eventually requiring the repair or replacement of the entire receptacle. This approach is thus not subject to widespread commercial acceptance or application.

Another approach, more recently advanced, is one which seeks to limit access to an electrical outlet by means of enclosing the outlet. These covering devices consist of a base plate (which replaces the existing outlet cover plate), and either hingedly attached, or removable covers. For example, U.S. Pat. No. 4,070,078 discloses a plate mounted over the electrical outlet to expose the sockets and which has a pair of spaced apart latching elements. These latching elements are hollow and hingedly connected to the plate and are provided with spaced apart flexible abutments engagable with the latching elements for securing the closure elements against different areas of the plate to thereby enclose the sockets and electrical plugs. This approach is complex in design and although it can be seen to be somewhat effective, it still relies totally upon the supposed inability of a child to exert sufficient pressure on the two flexible abutments. In fact, however, this can be accomplished by children as young as two years of age. Another problem which can be readily seen when looking at FIG. 1 of this patent, is that an object, such as a pencil or the like, can be placed in the gap between the two hollow closure elements and used to pry the closure elements open. Also, these closure elements, due to their shape and size, and the fact that they are only held in place by the two clips at the center of the plate, could be dislodged by a small child, who either grasped and twisted, or struck one or both of the elements with a toy or other similar object. For these reasons this approach is both too costly for widespread acceptance and may not be sufficiently effective in all situations.

Still another approach to the protection of children from electrical outlets is to cover the outlet with a protective cover and base plate, which require larger hands and more dexterity to operate than are present in most small children. For example, U.S. Pat. No. 4,652,696 discloses a base plate which replaces the conventional face plate of an electrical outlet, and a cover which is attached to the base plate and is secured to the base plate by three latches which must be simultaneously released to facilitate removal of the cover. It can readily be seen that this approach is, in theory, sound and superior to previous attempts to address this safety hazard. There are, however, several problems with this design, in both of its configurations. The most obvious of these is that the structure would be extremely expensive, if not impossible, to produce, due to the limitations of existing molding and materials technology. This is due to the depth of the cover and base plate sides. Also, because of its straight sided box configuration, a small child, of no more than one year of age, could break the entire structure away from the outlet by either sitting on, climbing on or striking the cover with a foot, toy or other object, thus exposing, not only the outlet and face plate, but the bare electrical wires within the wall. Another problem is with the nature and placement of the retaining latches. These latches are thin and all of the stress exerted, when they are pushed in to disengage the cover, is concentrated in one very small area. Accordingly, with repeated usage, they would lose their elasticity and thus their effectiveness. Also, because of their placement on the sides of the cover, these latches are highly visible and vulnerable to defeat by an inquisitive child using nothing more than a pencil or even a finger.

U.S. Pat. No. 4,603,932 overcomes the problem of the vulnerability of the retaining latches to access by a child and stress concentration by providing latching projections on the edge of the cover which engage in recesses in the receiving plate, but to obtain this engagement, the cover slides with a flange on the receiving plate, which makes the cover difficult to seal against the receiving plate.

My recently granted U.S. Pat. No. 4,899,019, also provides a solution to the problem of the retaining latches by mounting them within the housing as part of an inner housing, but also has the drawback that the outer cover must slide into a flange on the receiving plate so that the device is difficult to seal.

There still exists a need, therefore, for a safety cover which effectively prevents unauthorized access to an electrical receptacle, both when there is a plug in the outlet as well as when there is not, and which can also be easily sealed to prevent water and the like from getting into it so that it can be used out of doors. This device must also be designed in such a way that it can be manufactured, using existing material and technology, in sufficient quantities and at a low enough price as to be capable of the widest possible distribution.

OBJECTS AND BRIEF SUMMARY OF THE INVENTION

Accordingly, it is an object of this invention to provide a safety cover which denies unauthorized access by small children to electrical outlet sockets.

It is another object of this invention to provide a safety cover which denies access by small children to an electrical socket when the socket contains a plug.

It is a still further object of this invention to provide a safety cover which denies access by the elements when the socket contains a plug.

According to the present invention, a mounting plate means with a hole through its center, of sufficient size as to allow access to the electrical outlet box with electrical sockets therein, or with holes corresponding to the electrical sockets, is affixed to the outlet box, for example by means of an adhesive material adhering the mounting plate to the existing cover plate for the outlet box, or by a screw as a substitute for a cover plate. A cover assembly is adapted to be positioned over the mounting plate and secured thereto by locking projections, thereby enabling the assembly to be closed over the sockets while a plug or plugs are in the sockets. The electrical cord, necessarily attached to the plug, passes through a small hole located on the cover assembly to its corresponding electrical device.

The cover assembly has extending from it towards the receiving plate a plurality of locking projections having locking hooks thereon and each capable of being moved slightly toward the interior of the assembly. The mounting plate has apertures for receiving the locking hooks, thereby enabling the cover assembly to be interlocked with the mounting plate with the edge of the cover assembly in snug engagement with an edge engageable surface on the mounting plate. The assembly is unlocked, allowing the cover assembly to be removed, by simultaneously deforming parts of the cover assembly having the locking projections thereon so that the locking hooks move out of the apertures for the locking hooks.

The cover assembly can be any appropriate shape, such as rectangular, round or the like, but in a preferred embodiment, it is comprised of a box-shaped housing member. The housing member can have a hinging means on one side wall, which is hingedly connected to the mounting plate, a second side wall with attached locking hook, a top wall with attached locking hook, a bottom wall with attached locking hook, and a back wall. The three walls which have the locking hooks attached are independently depressible. In such a box-shaped housing member, the first and second side walls of the cover assembly are preferably parallel to a point approximately one third of the distance toward the back wall, at which point these walls angle inwardly and continue until they join to the back wall of the cover assembly. The top and bottom walls likewise are parallel to a point approximately one third of the distance toward the back wall, at which point these walls angle inwardly until they attach to the back wall of the cover assembly. The locking hooks extend toward the mounting plate, preferably from the center section of the distal edges of the first side wall and the top and bottom side walls. Pushing inwardly on the side walls will cause the locking hooks to be depressed, thereby removing the locking hooks from the means for receiving the locking hooks. To unlock and open or remove the cover assembly from the mounting plate, it is necessary to simultaneously push in on the three side walls which have locking hooks extending from them.

It can be seen, therefore, that locating the locking hooks centrally on the distal edges of three of the four opposing side walls and sufficiently far apart will prohibit unauthorized access. This is true, for example, in the case of children, whose hands are typically too small to reach and depress simultaneously, the central portions of the three side walls of the cover assembly which are adjacent the locking hooks. This central location of the locking hooks also serves to disperse the stresses associated with repeated opening and closing, thus increasing the durability of the device. It can also be seen that the compound angular design of the side walls will increase the amount of pressure necessary to depress the side walls and disengage the locking hooks, further decreasing the possibility of unauthorized access.

BRIEF DESCRIPTION OF THE DRAWINGS

FIG. 1 shows an exploded perspective view of a first embodiment of the safety cover of the present invention;

FIG. 1*a* is a fragmental sectional view taken on line 1A—1A of FIG. 1;

FIG. 1*b* is a fragmental perspective view of an alternative form of a hook receiving aperture;

FIG. 1*c* is a fragmental sectional view of an alternative form of a hook receiving aperture;

FIG. 2 shows a top view of the safety cover of the embodiment of FIG. 1 in the closed position and showing it in the open position in phantom lines;

FIG. 2*a* is a fragmental sectional view of one form of sealing gasket for the cover;

FIG. 2*b* is a fragmental sectional view of an alternative form of sealing gasket for the cover;

FIGS. 6 and 7 are perspective views of modified forms of the mounting plate and cover;

FIG. 8 is a perspective view of a further modified form of the safety cover according to the invention; and FIG. 9 is a sectional view taken on line 9—9 of FIG. 8.

DETAILED DESCRIPTION OF THE INVENTION

Figure 3:
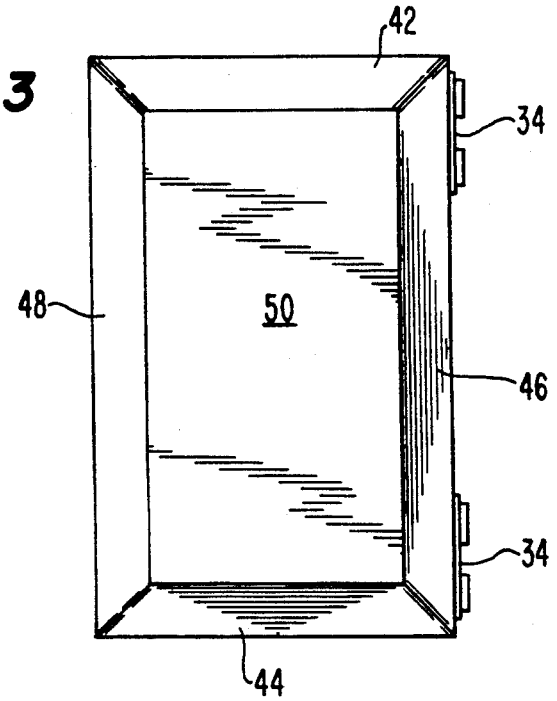
FIG. 3 is a front plan view of the safety cover of the embodiment of FIG. 1.

Referring to FIG. 1, a mounting plate 10 is provided for receiving a cover assembly 12, the assembly 12 being comprised of an outer housing member 40.

The mounting plate 10 of this embodiment is preferably rectangular in shape, having a face 13, a top edge 14, a bottom edge 16, a first side edge 18 and a second side edge 20. The plate 10 is designed to fit over a standard electrical receptacle such as an outlet box 22, which typically has a pair of electrical outlet sockets 24*a* and 24*b* covered by an apertured cover plate 23 attached to the outlet box 22 by a screw 23*a* (all shown in phantom lines). The mounting plate 10 has an outlet hole 26 through the plate 10. The plate 10 may be attached to the outlet box 22 by an adhesive 28 adhered to the outside face of plate 10.

Figure 4:
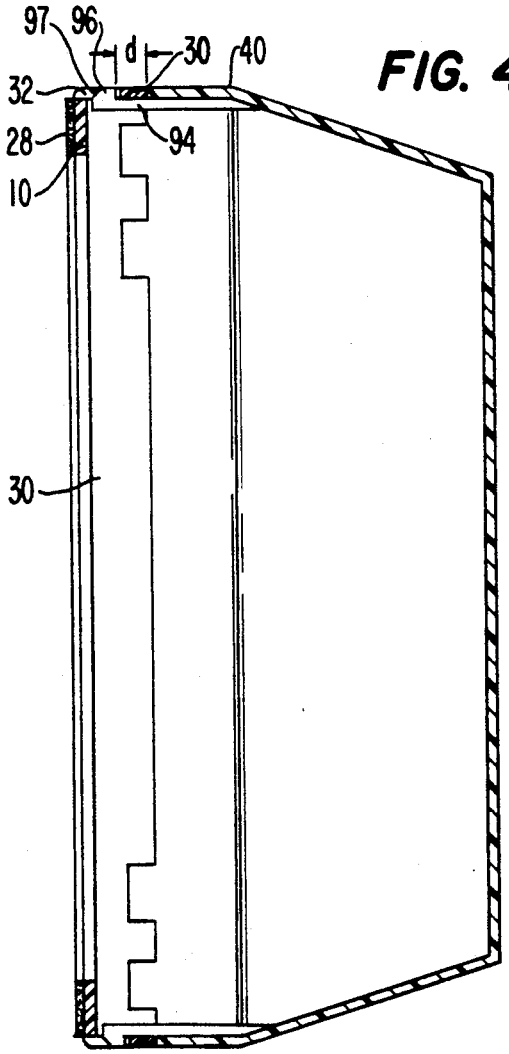
FIG. 4 is a sectional view taken on line 4—4 of FIG. 2.

The mounting plate 10 has, along its top edge 14, its bottom edge 16 and its first side edge 18 means for receiving locking hooks 96 on the outer housing member 40. These means may be comprised of a raised flange 30 having a free edge 30*a* forming an edge engageable surface to be engaged by an edge of the cover assembly 12 as described hereinafter. The flange 30 has through it locking hook receiving through-apertures 32, as shown in FIGS. 1, 2 and 4 extending transversely on the edge 30*a*. Alternatively, the aperture can extend into the mounting plate, as shown in FIG. 1*b* at 32*a*. This permits placing the engaging edge 32*b* of the through-aperture 32*a* closer to the outlet box engaging face of the mounting plate so as to make the free end of a locking hook 96 less accessible from outside the cover, and also permits making the mounting plate thicker. A still further alternative is shown in FIG. 1*c* in which the aperture is a closed bottom aperture as at 32*c*. This completely blocks access to the end of hook 96 from outside the cover.

In this embodiment the cover assembly is hinged to the mounting plate 10, and to this end means for hingingly attaching the cover assembly 12 along the second side edge 20 of the plate 10 is provided. This allows the cover assembly 12 to be swung to a closed position over the outlet box 22 or swung to an open position to allow access to the outlet sockets, as shown in FIG. 2. Any suitable hinge means can be used, but one preferred form may be comprised of hinge pins 34 located along the raised flange 30 on the second side edge 20, and a pair of connecting hinges 45*a* and 45*b*, located on the housing member 40 which fit around the pins 34, and thereby hingingly attach the cover assembly 12 to the mounting plate 10.

The cover assembly can be any appropriate shape. In the present embodiment, the outer housing member 40 is of a box like shape, and has five walls: a top wall 42, a bottom wall 44 opposite the top wall 42, a first side wall 46, a second side wall 48 opposite the first side wall 46, and a back wall 50. Opposite the back wall 50 is a housing member lateral opening 52 which fits over the face 13 of the mounting plate 10 when the cover assembly 12 is in the closed position. Around the lateral opening 52 is an edge 52*a* having a corner 52*b* at the junction of edge 52*a* and the interior of the housing 40. Each wall 42, 44, 46, 48 and 50 is of a length and width sufficient to provide a housing 40 of size great enough to be occupied by a standard electrical plug 15 and to fit, over the face 13 of the mounting plate 10. The first and second side walls 46 and 48 are parallel to a point approximately one third of the distance toward the back wall 50, at which point these walls angle inwardly and continue until they join the back wall 50. The top and bottom walls 42 and 44 are similarly shaped.

Located along the edge of each wall 42, 44 and 48, preferably at about the middle thereof, are locking means which in this embodiment are in the form of projections 94. Although one locking means per side is shown in the drawings, it will be understood that a plurality could also be used. The locking projections 94 extend out of the lateral opening 52 at the corner 52*b* of the edge 52*a* of the housing member 40, and they have locking hooks 96 at their face ends. The locking hooks 96 are attached to the inner surface of the wall on which they are mounted and extend transversely of edge 52*a* and they are spaced along projections 94 a distance d from the edge 52*a* substantially equal to the distance from the free edge of flange 30 to the edge of aperture 32 which is closest to the free edge of flange 30. As a result, the hooks 96 engage in the receiving holes 32 of the mounting plate 10 when the housing member 40 is swung to the closed position, thereby holding the cover assembly 12 in a locked position with the edge 52*a* snugly against the edge engageable surface 30*a* of flange 30 of the mounting plate 10 as shown in FIG. 4. An inclined surface 97 located on the side of the hook 96 engaging the raised flange 30 as the housing member 40 closes causes the hook 96 to be easily forced inwardly of the flange 30 and then slid along the inner surface of flange 30 and into the receiving aperture 32. The ends of the locking projections extend rearwardly of the parallel wall portions and are preferably faired into the inwardly angled wall portions, as shown in FIGS. 1*a* and 4, for increased strength, for making them substantially rigid with the corresponding wall, and to eliminate a rear edge so as to make them easy to mold when the cover is molded of plastic.

As a result, the edge 52*a* engaging the free edge 30*a* of angle 30 with a tight fit produces some sealing effect. As shown in FIGS. 2*a* and 2*b*, a water-tight seal can be easily formed by placing a strip of sealing material as a gasket 60 and/or 61 on one or both edges.

The simultaneous inward depression of walls 42, 44 and 48 in turn causes projections 94 to be moved inwardly and hooks 96 to be removed from the apertures 32. The cover assembly 12 can then be swung around its hinged side and brought to the open position, and the plug 15 and socket 24 exposed.

The dimensions of the cover assembly 12 allow the apparatus to cover an outlet box cover while a plug 15 is inserted into an outlet socket 24*a*, 24*b*. At least one cord aperture 38 is located in the bottom wall 44 of the outer housing member 40 to form a passage through which an electrical cord 17 attached to the plug which is inserted in the socket can be passed.

It is clear, therefore, that an appliance or other electrically operated device can be safely plugged into an outlet socket without the fear that a small child or the elements may gain access. Only a person having a hand of size large enough to depress all of the locking means simultaneously can gain access.

The central position of the locking hooks 96 along the edges of walls 42, 44 and 48 and the fact that they are substantially rigid with the corresponding walls causes them to remain substantially unbent when they engage the flange 30 so that the material of the housing 40 flexes inwardly within a relatively large arc around the respective locking hooks, whereby the stress and strain which is associated with repeated opening and closing of the housing member 40 is dispersed throughout the material of the housing 40 instead of being concentrated in the locking hooks.

The compound angular design of the side walls of the housing member 40 increases the amount of pressure necessary to depress the side walls to disengage the locking hooks 96, further reducing the possibility of unauthorized access to the outlet sockets, as well as making the process of grasping the housing more difficult for small hands. This configuration will also deflect a blow from a child's hand, foot, toy or the like, as well as discouraging an attempt by a child to sit or climb on the cover. However, it will be understood that the walls of the housing member can have other shapes and configurations without sacrificing the advantages of the exact shape shown and without departing from the scope of the invention. Such other shapes and configurations will suggest themselves to those skilled in the art from the foregoing description.

Figure 5:
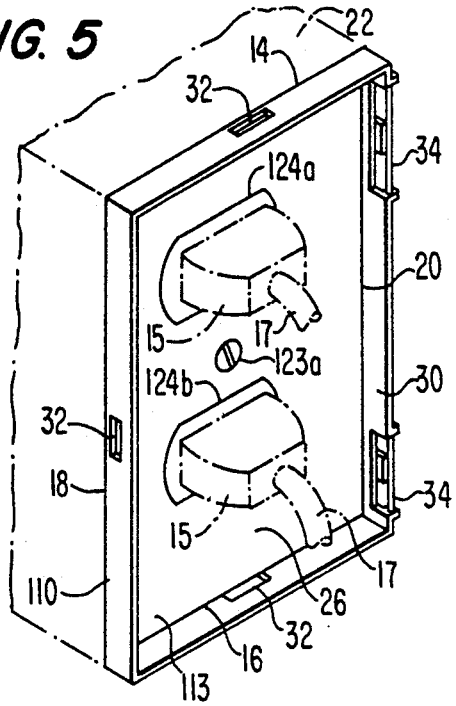
FIG. 5 is a perspective view of a modified form of mounting plate.

As shown in FIG. 5, the mounting plate 10 of FIGS. 1–4 can be replaced with a mounting plate 110, which has a face 113 with outlet socket receiving apertures 124*a* and 124*b* for fitting around outlet sockets 24*a* and 24*b* in an outlet box 22, and which has a screw 123*a* extending through a hole in the face 113 to engage a threaded hole in the outlet box to attach the mounting plate 110 over the outlet box as a replacement for a conventional cover plate. The mounting plate 110 is otherwise the same as the mounting plate 10 of FIGS. 1–4 and has the outer housing member 40 hinged thereto the same as in FIGS. 1–4.

Figure 6:
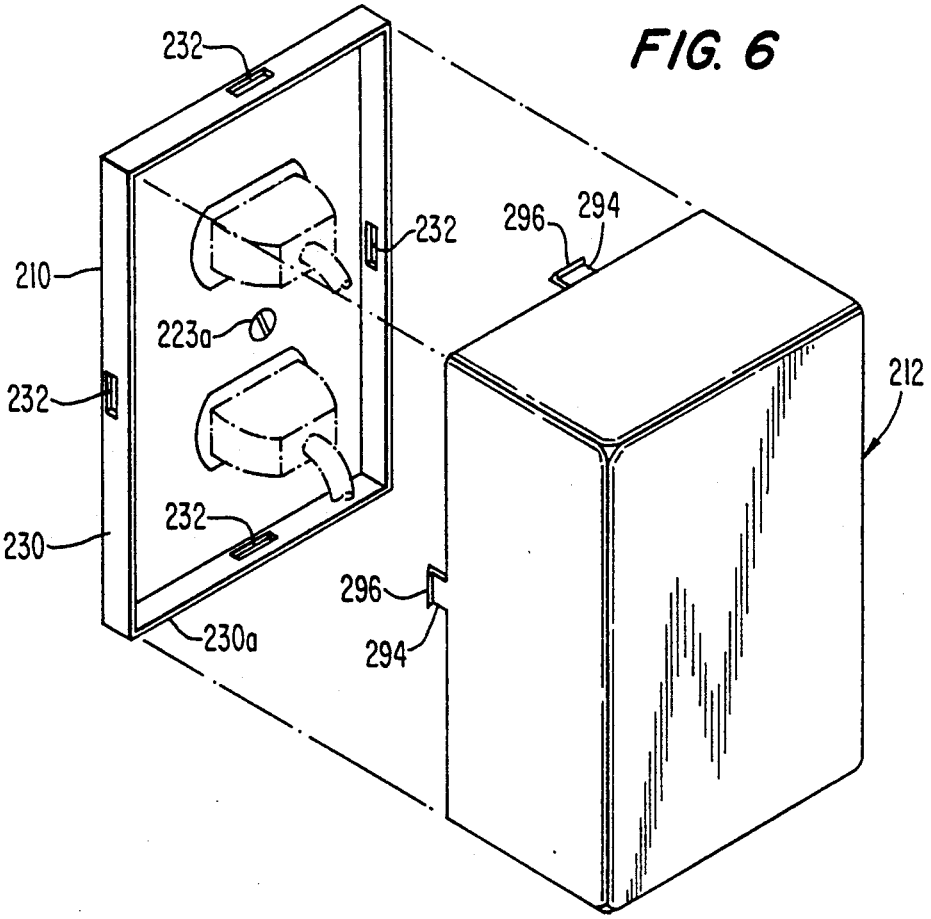

As shown in FIG. 6, the shape of the cover assembly can be a rectangular box shape 212, instead of the special shape as shown in FIGS. 1–4. Further, instead of being hinged to the mounting plate, the cover assembly 212 can have at least one additional locking projection 294 in addition to the three corresponding to those shown on the cover assembly in FIG. 1, the additional locking projection being on the wall corresponding to the wall having the hinge means in FIG. 1, and which additional locking projection is not visible in FIG. 6. The flange 230 on the mounting plate 210 has at least one additional locking hook receiving aperture 232 along the portion corresponding to that which has the hinge means thereon in FIG. 1. With this embodiment, the cover assembly is simply placed over the cover plate with the edge of the cover assembly against the edge engagable surface formed by the free edge of the flange 230, and the four locking hooks on the cover assembly snap into the four locking hook receiving apertures 232 to hold the cover assembly in the closed position. The cover assembly can be removed by depressing at least three of the side walls thereof with one hand to move the hooks 296 out of the apertures 232 on at least three sides of the cover assembly, at which point the fourth hook will act as a pivot around which the cover can be moved. Alternatively, two hands can be used to depress all the walls to move all of the hooks 296 out of all of the apertures, and then the cover assembly can be moved completely free of the mounting plate.

As seen in FIG. 7, the shape of the mounting plate can be other than rectangular. As an example of a different shape, FIG. 7 shows a round mounting plate 310 and a round cover assembly 312. Otherwise the structure is the same as that of the embodiment of FIG. 6.

In the embodiment of FIG. 8, the cover assembly 412 is the same as that of the embodiment of FIG. 1, except that the hinge means(not shown) is adapted to mount the cover assembly 412 on an oblique edge surface 410*a* of the cover plate 410 so that the entire edge 452*a* around the opening can seat snugly against the face of the cover plate 410. Otherwise, the shape is the same as that of FIG. 1, and the projections 494 and locking hooks 496 are the same as the embodiment of FIG. 1.

The mounting plate 410 is similar to a conventional face plate, in that the face thereof is flat, i.e. it has no upstanding flange corresponding to the flange 30 of FIG. 1. Instead, there are provided a plurality of locking hook receiving apertures 432 which extend downwardly through the face of the mounting plate and then laterally outwardly of the cover assembly transversely of the cover assembly edge 452*a*. The locking hooks 496, when the cover assembly 412 is moved to the closed position, move into the apertures and project laterally, engaging under the upper edge of the lateral opening. It will be seen from FIG. 9 that in this position, the edge 452*a* engages with a sealing gasket 460 in a groove 410*b* in the face of the mounting plate 410 and having a shape corresponding to the edge 452*a* of the cover assembly. It will of course be necessary for the apertures 432 where they open through the mounting plate to be sufficiently large in the direction outwardly of the cover assembly so that the locking hook 496 in each hole can move laterally sufficiently far to be able to move into and out of the hole. It will further be understood that the groove 410*b* and/or the gasket 460 can be omitted, in which case the face of the mounting plate becomes the edge engagable face against which the edge 452*a* snugly engages when the cover assembly is in the closed position.

There may be further provided shielding walls 432*a* and 432*b* extending downwardly on the side of the aperture inwardly from the edge of the mounting plate 410 and then outwardly toward the edge of the mounting plate. These are to shield the aperture from the sockets 424*a* and 424*b* in the receptacle over which the mounting plate is mounted.

It will thus be seen that there has been provided a safety cover for an electrical receptacle which can be easily mounted on the receptacle and which is held against edge engagable surfaces on the mounting plate therefore so as to substantially seal the interior of the cover to avoid entry of foreign substances, and yet which can be easily removed by an adult who can manipulate the cover assembly so as to simultaneously disengage three locking projections which cannot be disengaged by a child.

What is claimed is:

1. A safety cover for an electric receptacle, comprising:

a mounting plate capable of being affixed to an electrical receptacle for lockingly receiving a cover assembly;

a cover assembly having a cover with a lateral opening and a cover edge extending around the periphery of said lateral opening;

said mounting plate having an edge-engagable surface thereon corresponding in shape to said cover edge;

said cover assembly being mountable on said mounting plate so as to be movable between a closed position in which said cover edge abuts said edge-engagable surface and an open position in which said cover edge is spaced from said edge-engagable surface to expose an electrical receptacle to which said mounting plate has been attached for the intended use of said safety cover, said cover assembly having at least three locking means spaced around the periphery of said lateral opening, the spacing of said locking means being sufficient for making said locking means incapable of simultaneous operation by a hand below a predetermined size, said mounting plate having a locking-hook-receiving aperture therein extending substantially transversely of said cover edge and outwardly of said cover assembly at a position along said edge-engagable surface corresponding to the positions of each of said locking means along the periphery of said lateral opening, said locking means having a locking projection extending out of said lateral opening adjacent said cover edge and having a free end with a locking hook thereon which extends transversely of said locking projection and said cover edge and outwardly of said cover and which is spaced along said projection from said cover a distance for, when said cover assembly is moved t the closed position, engaging said locking hooks in said locking-hook-receiving apertures with said cover edge snugly abutted against the edge-engagable surface, whereby said cover assembly can be moved to the open position only by simultaneous deformation of the locking-means-carrying portions of said cover at the positions of said locking means sufficient to move said locking hooks sufficiently far inwardly of said cover assembly to free said locking hooks from said locking-hook-receiving apertures.

2. A safety cover as claimed in claim 1 in which said mounting plate has a raised flange extending along the edge thereof with a free edge on said flange forming said edge engagable surface, and said hook receiving apertures are through apertures in said raised flange and extend into the part of said mounting plate from which said raised flange extends.

3. A safety cover as claimed in claim 1 in which said mounting plate has a raised flange extending along the edge thereof with a free edge on said flange forming said edge engagable surface, and said locking hook receiving apertures are closed bottom apertures opening toward the interior of said safety cover.

4. A safety cover as claimed in claim 1 in which said cover assembly comprises a cover member having spaced opposed upper and lower walls and spaced opposed side walls joining said upper and lower walls, one of the edges of said thus joined walls defining said lateral opening and the other of the edges having a rear wall joined thereto closing said cover member, each of said upper, lower and side walls having a portion adjacent said lateral opening parallel to the opposed wall and having a portion angled inwardly of said cover member from said parallel portion to said rear wall, and each said locking projection extending inwardly of said housing member along the parallel wall portion and being faired into the inwardly angled wall portion corresponding thereto for making the locking projections substantially rigid with the corresponding wall.

5. A safety cover as claimed in claim 1 further comprising sealing means around the opposed edges of at least one of said edge engageable surface and said cover assembly.

6. A safety cover as claimed in claim 1 in which said mounting plate has a central outlet hole therethrough adapted to fit over a cover plate on a receptacle, and has adhesive means on the face of said mounting plate facing away from said cover assembly for adhering said mounting plate to a cover plate on an outlet with outlet sockets on the receptacle exposed through the central outlet hole.

7. A safety cover as claimed in claim 1 or 6 in which said mounting plate has at least one outlet-socket-receiving aperture therethrough adapted to fit over an outlet socket in an outlet box, and mounting means for mounting said mounting plate on an outlet box in place of a cover plate.

8. A safety cover as claimed in claim 1 in which said locking means are spaced around the entire periphery of said lateral opening and said cover assembly is completely removable from said mounting plate by disengagement of said locking hooks.

9. A safety cover as claimed in claim 1 in which the face of said mounting plate constitutes said edge-engageable surface, and said locking-hook-receiving apertures extend through said mounting plate and open laterally outwardly below said mounting plate.

10. A safety cover as claimed in claim 9 further comprising a shielding wall extending downwardly from said mounting plate on the inner side of each of said hook-receiving apertures where it opens through the mounting plate and a further shielding wall extending outwardly from the lower end of the downwardly extending shielding wall.

* * * * *

UNITED STATES PATENT AND TRADEMARK OFFICE

CERTIFICATE OF CORRECTION

PATENT NO. : 5,218,169

DATED : June 8, 1993

INVENTOR(S) : Robert G. RICEMAN

It is certified that error appears in the above-identified patent and that said Letters Patent is hereby corrected as shown below:

Column 9, line 41, "t" should read --to--.

Signed and Sealed this

Nineteenth Day of April, 1994

*Attest:*

Bruce Lehman

BRUCE LEHMAN

*Attesting Officer*

*Commissioner of Patents and Trademarks*